US011404196B2

(12) United States Patent
Findeisen

(10) Patent No.: US 11,404,196 B2
(45) Date of Patent: Aug. 2, 2022

(54) CORE FOR AN ELECTRICAL INDUCTION DEVICE

(71) Applicant: Siemens Energy Global GmbH & Co. KG, Munich (DE)

(72) Inventor: Joerg Findeisen, Dresden (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 496 days.

(21) Appl. No.: 16/348,582

(22) PCT Filed: Oct. 10, 2017

(86) PCT No.: PCT/EP2017/075720
§ 371 (c)(1),
(2) Date: May 9, 2019

(87) PCT Pub. No.: WO2018/086810
PCT Pub. Date: May 17, 2018

(65) Prior Publication Data

US 2020/0058433 A1 Feb. 20, 2020

(30) Foreign Application Priority Data

Nov. 9, 2016 (DE) ..... 10 2016 221 992.8

(51) Int. Cl.
*H01F 27/08* (2006.01)
*H01F 27/245* (2006.01)
(Continued)

(52) U.S. Cl.
CPC ..... *H01F 27/245* (2013.01); *H01F 3/00* (2013.01); *H01F 3/02* (2013.01); *H01F 27/08* (2013.01);
(Continued)

(58) Field of Classification Search
CPC . H01F 27/245; H01F 3/00; H01F 3/02; H01F 27/26; H01F 27/263; H01F 27/266; H01F 27/08
See application file for complete search history.

(56) References Cited

U.S. PATENT DOCUMENTS 1,769,871 A * 7/1930 Unger ..... H01F 27/245 336/60
3,183,461 A 5/1965 Tipton
(Continued)

FOREIGN PATENT DOCUMENTS

CA 1157115 A 11/1983
CN 103854829 A 6/2014
(Continued)

OTHER PUBLICATIONS

PCT International Search Report and Written Opinion of International Searching Authority dated Jan. 19, 2018 corresponding PCT International Application No. PCT/EP2017/075720 filed Oct. 10, 2017.

*Primary Examiner* — Tuyen T Nguyen
(74) *Attorney, Agent, or Firm* — Laurence A. Greenberg; Werner H. Stemer; Ralph E. Locher

(57) ABSTRACT

A core for an electric induction device includes a multiplicity of magnetizable metal sheets which form a stack of metal sheets resting on each other. Spacers that are each disposed between two metal sheets form at least one cooling channel which can be subjected to a greater thermal load and at the same time allows improved cooling. Said spacers are made, at least in part, of metal.

19 Claims, 10 Drawing Sheets

(51) Int. Cl.
*H01F 3/02* (2006.01)
*H01F 27/26* (2006.01)
*H01F 3/00* (2006.01)

(52) U.S. Cl.
CPC ..... *H01F 27/26* (2013.01); *H01F 27/263* (2013.01); *H01F 27/266* (2013.01)

(56) References Cited

U.S. PATENT DOCUMENTS

| | | | |
|---|---|---|---|
| 2012/0299680 | A1 | 11/2012 | Zajc |
| 2014/0132380 | A1 | 5/2014 | Jacobson et al. |

FOREIGN PATENT DOCUMENTS

| | | | | | |
|---|---|---|---|---|---|
| CN | 103904836 | B | | 7/2014 | |
| CN | 105280354 | A | | 1/2016 | |
| CN | 105810407 | A | | 7/2016 | |
| CN | 106024322 | A | | 10/2016 | |
| EP | 0040382 | A1 | | 11/1981 | |
| EP | 0264611 | A1 | * | 4/1988 | ..... H01F 27/085 |
| JP | S55156312 | A | | 12/1980 | |
| JP | 62140710 | A | * | 6/1987 | |
| JP | 62244113 | A | * | 10/1987 | |

* cited by examiner

CORE FOR AN ELECTRICAL INDUCTION DEVICE

BACKGROUND OF THE INVENTION

Field of the Invention

The invention relates to a core for an electrical induction device having a plurality of magnetizable metal sheets, which form a stack of metal sheets resting on each other, wherein spacers which are arranged between two metal sheets form at least one cooling channel.

A core of this type is known from the prior art, and is employed in electrical induction devices including, for example, transformers or reactance coils. For the suppression of eddy currents, the core comprises a plurality of flat magnetizable metal sheets, the flat sides of which are arranged one against another to constitute a sheet metal stack. Spacers can be arranged between two metal sheets which, in combination with the two metal sheets between which they are arranged, together delimit cooling channels. These cooling channels permit the evacuation of heat losses generated in the core. Disadvantageously, however, the spacers occupy additional space, and reduce the fullness factor of the core. Moreover, the spacers cover a substantial proportion of the surface of the two metal sheets with which they are in contact. As a result of the low thermal conductivity of the material of the spacers, this proportion of the respective metal sheet is not available for thermal convection.

Specifically in the light of the employment of new insulating fluids for the insulation and cooling of the active part of an induction device, it is desirable that the core, as a constituent of the active part, can be configured to be as compact as possible wherein, simultaneously, effective cooling is permitted.

SUMMARY OF THE INVENTION

The object of the invention is therefore the provision of a core of the above-mentioned type, which can accommodate greater thermal loads and which simultaneously allows improved cooling.

This object is achieved by the invention, in that the spacers are at least partially comprised of metal. By the use of at least partially metallic spacers, greater thermal conductivity in the core is provided.

The spacers in the cooling channel of the core are arranged and configured such that contact surfaces for the transmission of heat to the metallic spacers are constituted between the core metal sheets which delimit a cooling channel and the spacers, and the outer surfaces of the spacers which are not in contact with the core metal sheets constitute convection surfaces for the evacuation of the heat to the cooling fluid which is present in the cooling channel. The transmission of heat from the core to the insulating fluid is facilitated accordingly, such that a higher cooling capacity is achieved. In other words, in the context of the invention, the useful surface area which is available for thermal conduction and convection is increased. This results in more efficient cooling. The core according to the invention, for an equal cooling capacity, can be provided with smaller cooling channels or with a reduced number of cooling channels, such that the core is configured to be more compact.

In many cases, the materials of the spacers selected according to the prior art are not capable of withstanding the permissible temperatures, especially when insulating fluids which are capable of accommodating a higher thermal loading, such as ester oils, are used. The metallic spacers in the context of the invention can be exposed to higher temperatures, with no resulting damage.

According to the invention, the core can thus withstand higher thermal loads. Moreover, according to the prior art the mechanically soft spacers, which in many cases are manufactured from materials that can accommodate only limited thermal loading, are omitted. Furthermore, metallic spacers are cost-effective, such that the production costs for the core according to the invention are reduced in comparison with the prior art.

The at least partially metallic spacers employed are preferably configured as flat bars. In the sheet metal stack, the spacers engage, at their planar flat sides, with the core metal sheets which enclose the cooling channels.

Advantageously, the spacers, on each side thereof which faces a metal sheet, are provided with an electrically insulating insulation layer. Conversely, the two sides of the spacer which do not face a metal sheet are provided with no insulation layer. In this manner, any constitution of bridges between the core metal sheets which is conducive to ring currents or eddy currents in the spacers can be prevented. As an insulation layer, for example, a phosphate coating or a layer of insulating lacquer of low layer thickness can be considered.

In a preferred embodiment of the invention, the spacers are solid bars arranged with a mutual spacing, wherein semi-finished steel or aluminum parts are preferably employed for the production of the spacers. The spacers are preferably configured with an overhang in relation to the adjoining core metal sheets, in order to further increase the useful surface area available for convection.

According to a further advantageous configuration of the invention, the spacers are not configured as continuous bars, but constitute spacer segments, which are arranged with a mutual spacing on a sheet metal plane.

These spacer segments are preferably arranged on the core metal sheet surface with a mutual offset, in order to generate turbulence in the flow of the insulating fluid.

Preferably, the spacers are at least partially configured as hollow sections. As the inner surfaces of the latter are also in contact with the flowing insulating fluid, the available surface area for convection is increased, and the effectiveness of cooling is further enhanced accordingly. Cost-effective hollow sections are commercially available.

According to a further variant, the spacers are comprised of a plurality of mutually spaced spacer segments, which are connected to one another by means of connecting webs, wherein the height of the connecting webs corresponds to no more than half the height of the cooling channel, in order to prevent any impairment of the flux of the cooling fluid. Advantageously, these connecting webs are configured such that they contribute to the turbulence of the flux of the cooling fluid.

In a further variant, the spacers are at least partially configured as round-section bars.

According to a preferred configuration of the invention, the spacers are at least partially formed of a magnetizable material, and are specifically formed of layered magnetizable metal sheets. Accordingly, magnetizable spacers, in common with the other metal sheets of the core, can accommodate the magnetic flux and, in this manner, contribute to the increase in the magnetic cross section of the core. According to this further development of the invention, it is particularly advantageous if the spacers are comprised of layered magnetizable metal sheets. The layered design of the magnetizable metal sheets serves for the suppression of eddy currents in the spacers.

In a further configuration of the invention, only the respective outer regions of the spacers which engage with the metal sheets of the core are formed of a magnetizable material, whereas the inner region is comprised of a substantially non-magnetic metallic material.

The magnetizable material of the spacers preferably assumes a preferred direction of magnetization.

In a preferred configuration of the invention, the metal sheets of the spacers are arranged in the same layer direction and with the same preferred direction of magnetization as the core metal sheets which enclose the cooling channel.

The layered metal sheets of the spacers are preferably bonded by an adhesive or lacquer to form bar-shaped stacks.

The preferred direction of magnetization is appropriately oriented. The preferred direction of magnetization is thus appropriately oriented obliquely, or at an angle to a joint which extends through the core, for example in a region of the core in which sheet metal edges meet, thereby constituting the above-mentioned joint. This region of the core is described hereinafter as the abutment region. The joints respectively constituted by two mutually abutting metal sheets can be mutually offset from one sheet metal layer to the next. The joint is magnetically bridged by the magnetic spacers, and the magnetic resistance of the joint is reduced accordingly.

The spacers preferably extend above the abutment region of the core metal sheets. The spacers and the mutually abutting sheet metal edges of the sheet metal stack, in a sectional side view of the core, thus form an angle. In the context of the invention, in consideration of the preferred direction of magnetization of the core metal sheets and the preferred direction of magnetization of the spacer, this angle can be configured such that a desired magnetic flux distribution is achieved.

In a preferred configuration, the spacers, comprised of magnetic material having a preferred direction of magnetization, in the region of the joint between a limb metal sheet and a yoke metal sheet, are oriented such that the angle between the preferred direction of magnetization of the magnetic material of the spacers and the joint lies between 70° and 110°. By this arrangement, an effective bridging of the joints can be achieved, together with an advantageous magnetic flux distribution in the region of the core surrounding the cooling channel.

In a further configuration of the invention, the spacers are fitted with at least one spring element. The spring element provides a certain degree of damping. This therefore facilitates the production of the core, and additionally improves the mechanical load distribution within the core. By means of this effect, damping is achieved, with a consequent reduction in core noise caused by magnetostriction.

Advantageously, the spacers are comprised of an expanded metal mesh or a wire mesh. Expanded metal meshes or wire meshes are cost-effective, and can easily be fitted between two core metal sheets during manufacture of the core. Advantageously, a non-conductive locking mechanism is incorporated in openings in the expanded metal mesh structure. The manufacture of the core according to the invention is even further simplified accordingly. The metal sheets, for example, can thus be fitted with retaining pins which project from their stack surface.

Advantageously, the expanded metal mesh is secured in an elastically bent position in the sheet metal stack. According to this configuration of the invention, the expanded metal mesh delivers an advantageous spring action, as already described above, thereby permitting mechanical damping, simplified manufacture, and superior mechanical integrity of the core.

In an appropriate further development of the invention in this regard, the spacers are configured in the form of wire mesh. Wire mesh is also commercially available at a low cost. The constituent wire of the wire mesh preferably has a circular or elliptical cross section, such that edges or points are avoided in the wire mesh which might damage the insulation of the core metal sheet.

Corrugated wire nettings can be employed in numerous different variants, thus permitting straightforward adaptation to the geometrical characteristics of the core.

A wire mesh or wire netting is comprised, for example, of two interwoven wires and/or additional reinforcing wires, where applicable. Both wires can be alternately corrugated. In a deviation from this arrangement, corrugated wires enclose a straight, non-corrugated wire. In a further variant, the spacers are configured in the form of a spiral-wound spring-wire mesh.

Advantageously, a netting of this type is constituted such that the corrugations of constituent wires of the wire netting, which constituent wires are substantially horizontally arranged in the subsequent installation position of the core, are configured such that the coverage of the vertical cooling channel corresponds to a maximum of one half of the width of the cooling channel. Advantageously, these connecting webs are configured such that they contribute to the turbulence of the flux of the cooling fluid.

According to a preferred configuration of the invention, the spacers incorporate a fixing section, by means of which the spacer projects out of the sheet metal stack. The fixing section can be employed for the purposes of fixing, but also for the lifting or transport of the core. The formation of a mechanically stable fixing section is only permitted by the selection of a metallic material for the spacers.

Further advantages are provided by the constitution of the fixing section as a hook, an eye or similar, in order to facilitate the lifting or attachment of the core.

Appropriately, the fixing section is fitted with a mounting bracket. The mounting bracket, for example, is likewise formed of a metallic material, and is permanently attached to the fixing section, for example by the molding thereof onto the latter. The mounting bracket serves for the mechanical connection to components of the induction device, including e.g. the top cover of a transformer.

In the variant of the invention in which the spacers are comprised of a magnetizable material, it is advantageous that the spacers incorporate an inner region of a non-magnetic metallic material. In a cross-sectional view of the spacer, a sandwich arrangement is thus provided, wherein the inner region is embedded between two magnetizable outer sections of the spacer. The two magnetizable outer sections are respectively arranged to face the sheet metal stack of the core.

In a further development in this regard, the magnetizable outer regions are likewise comprised of layered magnetizable metal sheets.

Appropriately, the spacers of the upper yoke, on the side thereof which, in the case of an application in a transformer, faces a winding which carries a high voltage, are extended beyond the lower edge of the yoke and, in the region of overlap with the yoke (5), constitute an arch over the winding, which partially covers the yoke (5). The function of this arch is the prevention of high electric field strengths.

BRIEF DESCRIPTION OF THE SEVERAL VIEWS OF THE DRAWING

Further appropriate configurations and advantages of the invention are the subject of the following description of exemplary embodiments of the invention with reference to the figures in the drawing, wherein components of identical function are identified by the same reference numbers, and wherein.

DESCRIPTION OF THE INVENTION

Figure 1:
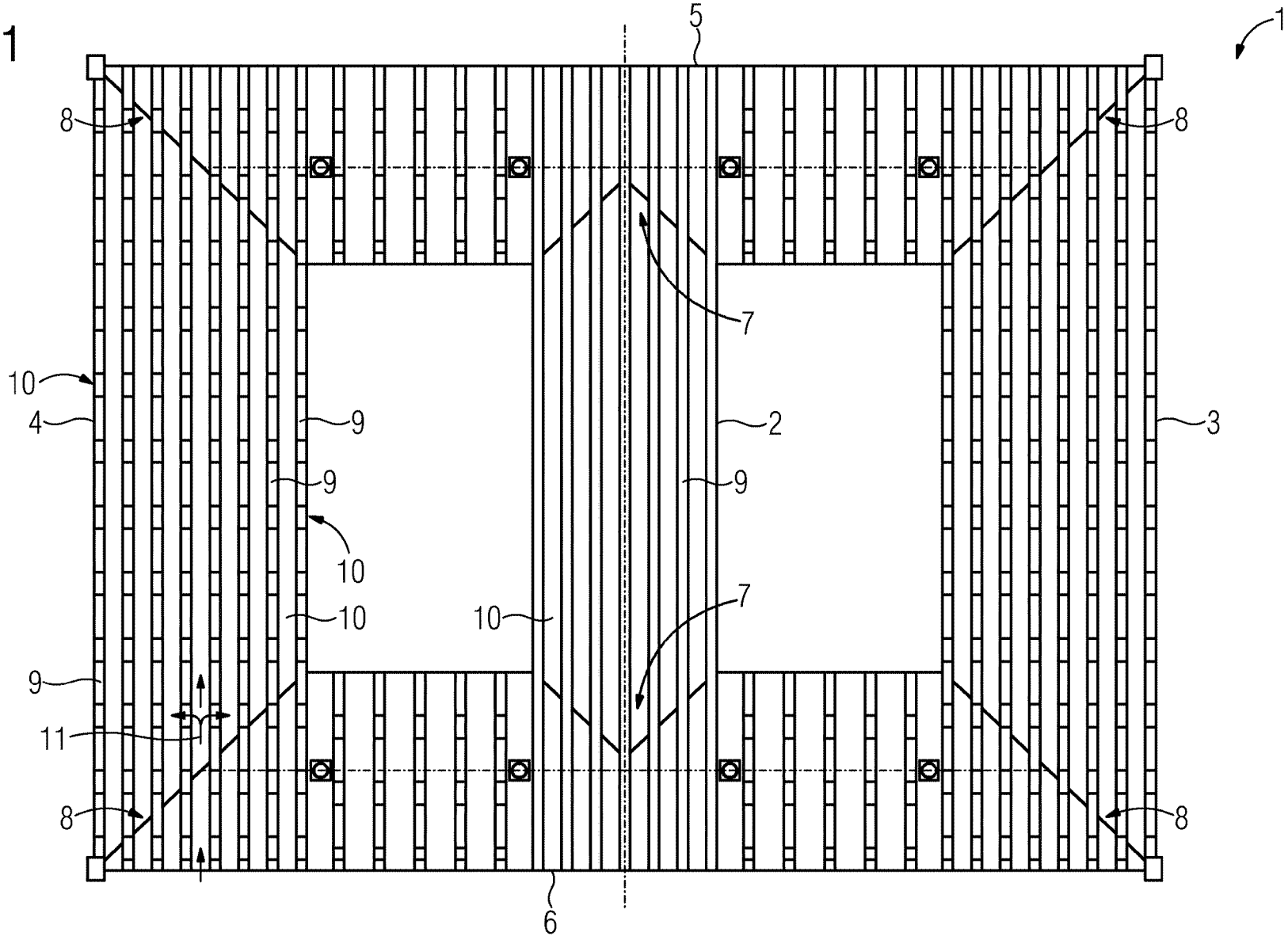
FIG. 1 shows a schematic illustration of an exemplary embodiment of the core according to the invention, in a sectional side view.

FIG. 1 shows an exemplary embodiment of the core 1 according to the invention, in a partially sectional side view. The core comprises three core limbs 2, 3 and 4. The core 1 moreover incorporates an upper yoke 5 and a lower yoke 6. The core 1 is formed of flat, i.e. planar magnetizable metal sheets, in order to prevent eddy current losses in an application thereof in a transformer or a reactance coil. The metal sheets are arranged adjacently to one another at their flat sides. FIG. 1 shows a metal sheet from the center of the core 1, in an overhead view. Metal sheets are stacked in an inward direction to, or outward direction from, the drawing plane.

In abutment regions 7, the illustrated metal sheet of the core limb 2 is configured with a V-shape at both ends thereof. The metal sheet illustrated here abuts against metal sheets of the upper or lower yoke 4, 5, thereby constituting a joint. The same applies correspondingly to the metal sheets arranged below or above the drawing plane. Further abutment regions 8 are present between the core limbs 3 and 4 and the upper yoke 5 or the lower yoke 6. In the abutment regions 8, the mutually adjoining metal sheets of the core 1 also constitute an obliquely-oriented joint.

Between two metal sheets which extend in parallel to one another, spacers 9 are arranged, which are constituted of a metallic material. The spacers 9 of the central core limb 2, in the exemplary embodiment represented, are configured as solid bars which, in the exemplary embodiment illustrated, are configured with a rectangular cross section. Between the spacers 9 which, in a single plane, are all arranged with the same mutual spacing, cooling channels 10 extend.

Conversely, the spacers 9 of the core limbs 3 and 4 are not configured as continuous bars. Instead, the spacers are configured in the form of blocks, wherein the individual blocks are not mutually connected, but delimit transverse channels, by means of which the cooling channels 10 oriented in a mutually parallel arrangement in the longitudinal direction of the core limbs 3, 4 are interconnected. The flux of an insulating fluid in this region is schematically represented by the arrows 11. In a further configuration of the invention, the block-shaped configuration of the spacers 9 can be achieved by the use of a wire mesh or similar.

Heat losses are transmitted from the metal sheets to the insulating fluid flowing through the cooling channels 10, and can thus be effectively evacuated from the core 1.

Figure 2:
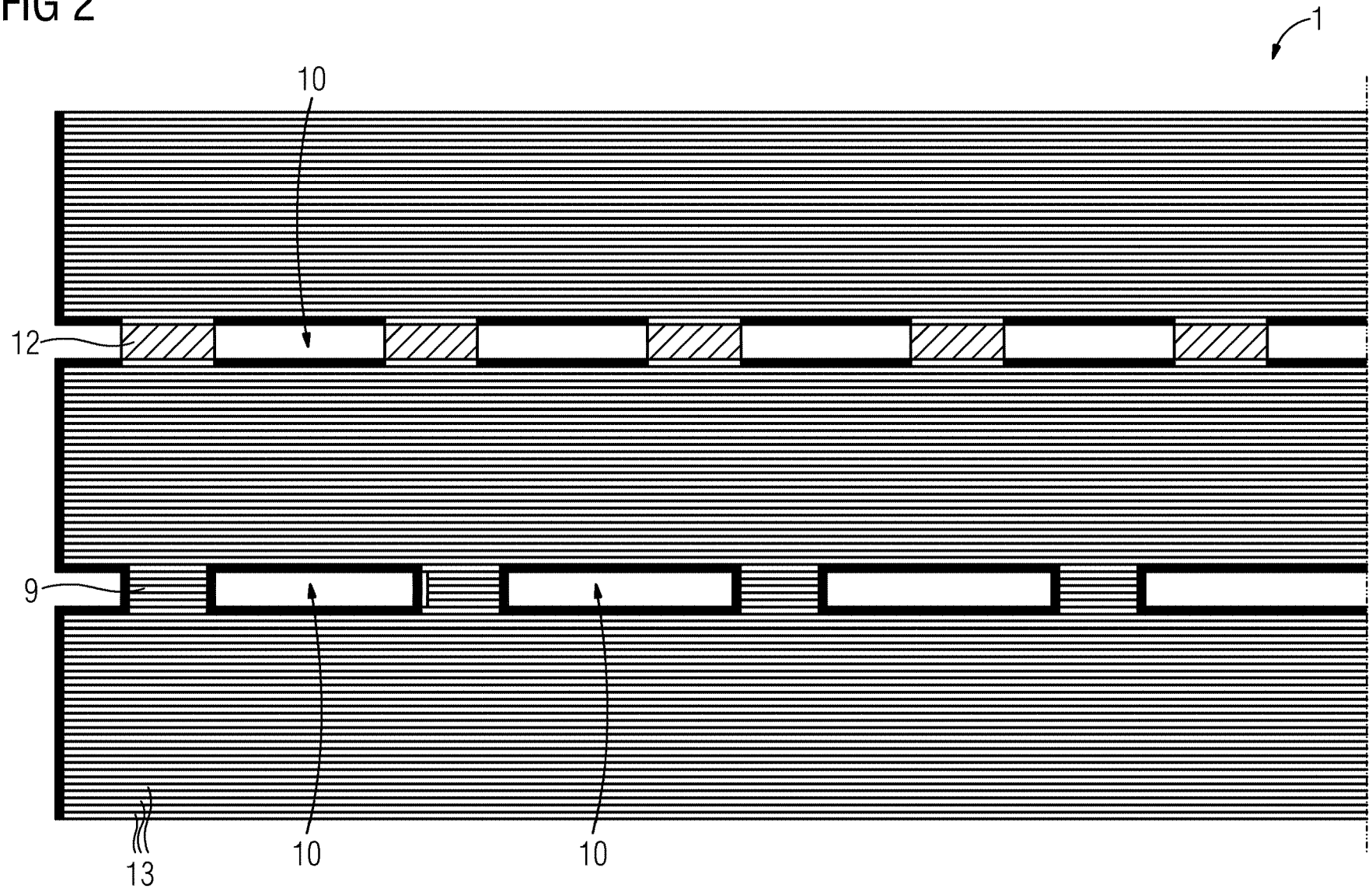
FIG. 2 shows a schematic representation of a core, which is constituted of layered individual flat metal sheets, and incorporates both spacers according to the prior art and metallic spacers according to the present invention.

FIG. 2 illustrates the constitution of the sheet metal stacks in the limb of a core 1, which is fitted both with spacers 9 according to the invention and with spacers 12 according to the prior art. In the representation of the core 1, which is enlarged in relation to FIG. 1, metallic spacers 9 according to the invention can be observed in the lower half, whereas the spacers 12 in the upper part of FIG. 2 are formed of an insulating material, according to the prior art. The outer surfaces of the metal sheets 13, which face a cooling channel 10 and which simultaneously permit an exchange of heat with the insulating fluid flowing in the cooling channel 10, are represented here by bold lines. It can be seen that, in this manner, the cooling channels 10 in the lower section, where a metallic spacer 9 is employed, feature a thermally-conductive delimitation over their full perimeter. Conversely, no transmission of heat occurs between the flat sides of the spacers 12 and the insulating fluid in the cooling channel 10. In a core according to the prior art, the transmission of heat occurs exclusively via the flat sides of the metal plates 13 which delimit the cooling channel. It is thus clarified that the exchange of heat is improved in the context of the invention.

Moreover, the spacers 9 in the exemplary embodiment illustrated are formed of layered magnetizable metal sheets 13. In the exemplary embodiment, the metal sheets 13 of the spacers 9 are arranged in the same layer direction and with the same preferred direction of magnetization, and are formed of the same material as the core metal sheets 13 which enclose the cooling channel 10.

In the core section represented, the magnetically active cross section of the core is increased by the spacers 9 accordingly. The spacers 9 are therefore capable of accommodating a proportion of the magnetic flux carried by the core 1. The fullness factor of the core increases. This effect can be exploited for the reduction of the maximum induction, for example for the suppression of core noise, or for the reduction of the diameter of the core limb.

Figure 3:
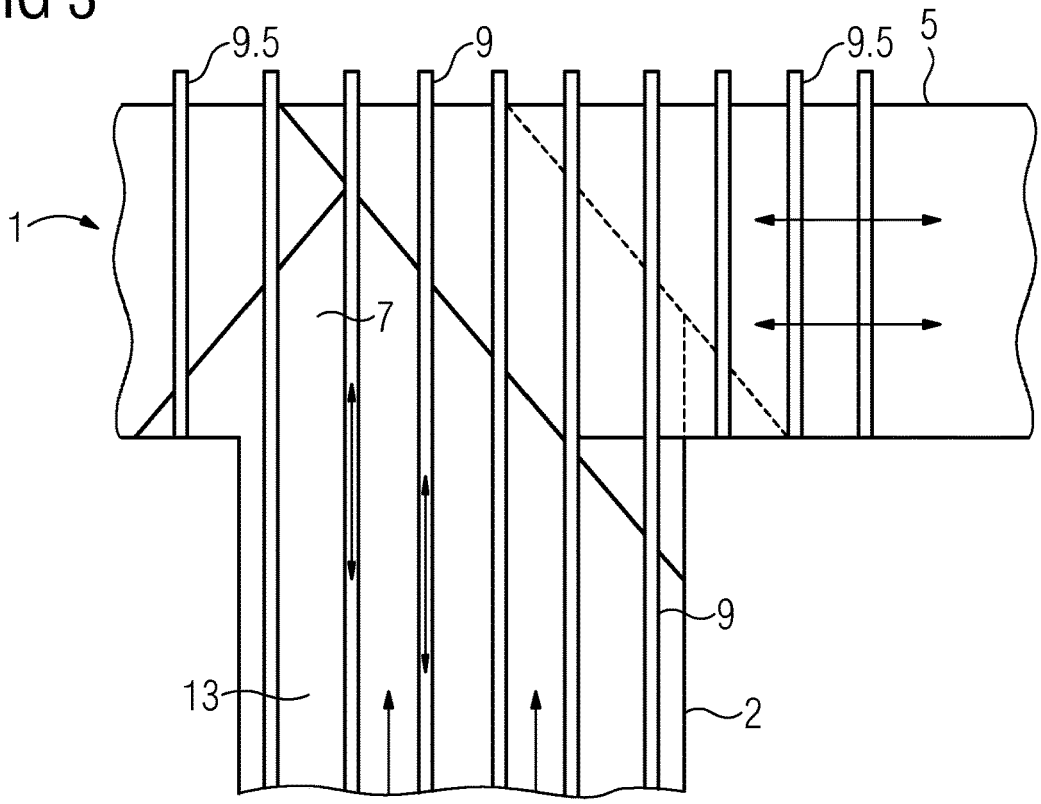
FIG. 3 shows a schematic illustration of an abutment region with spacers, in a side view.

FIG. 3 shows the abutment region 7 of the core 1 according to the invention in greater detail. It can be seen that, in the abutment region 7, a joint is configured, which is constituted by the mutually abutting edges of metal sheets. The joints between the pairs of metal sheets are mutually offset from one layer to the next. This is indicated by the broken line, which illustrates a joint which is arranged to the rear of the drawing plane. In the exemplary embodiment illustrated, the spacers 9 of the limb 2 are formed of a laminated magnetizable material, which assumes a preferred direction of magnetization. The laminated magnetizable spacers 9 moreover extend into the upper and lower yoke region. The preferred direction of magnetization of the metal sheets 13 of the core and the preferred direction of magnetization of the spacers 9 are indicated by double-headed arrows.

In the exemplary embodiment illustrated, it is essential that the spacers 9 extend in an angular arrangement through the abutment region 7, and thus through the joints configured therein. The preferred direction of magnetization of the spacers 9 and the preferred direction of magnetization of the layered metal sheets 13 of the core 1 are oriented in relation to each other, and in relation to the joint, such that an advantageous magnetic flux distribution is achieved in the core 1 where the latter is employed in a transformer or in a reactance coil.

Sections 9.5 of the spacers 9 which are arranged in the yoke region 5, but outside the abutment region, and consequently do not overlap the joint between the core metal sheet of the limb and the core metal sheet of the yoke, in the exemplary embodiment illustrated, are not formed of a magnetizable material such as magnetic sheet steel, but of a non-magnetizable metallic material. In the exemplary embodiment, the layered metal sheets of the spacers 9 are bonded by an adhesive or a lacquer to constitute bar-shaped stacks.

Figure 4:
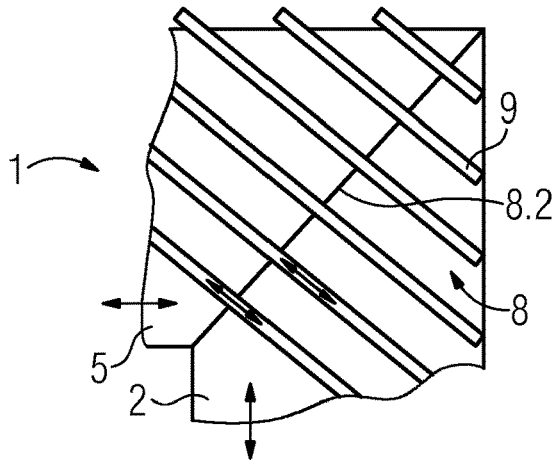
FIG. 4 shows a schematic representation of a further abutment region with spacers.

FIG. 4 shows the abutment region 8 between the upper yoke and the limb of a core according to FIG. 1, wherein the spacers 9, again in this case, extend through the abutment region 8. In the exemplary embodiment represented, only those sections of the spacers 9 which are arranged in the abutment region 8 of the core metal sheets 13, and which therefore extend through the joints 8.2 constituted between metal sheets, are comprised of a magnetizable material. The metal sheets 13 of the core yoke 5, 6 and the core limb 3, for the reduction of no-load losses, have a preferred direction of magnetization in the longitudinal direction of the metal sheet. At the joint 8.2, there is thus a change in the preferred direction of magnetization through an angle of approximately 90 degrees.

In the exemplary embodiment according to FIG. 4, the spacers 9 in the abutment region 8 are likewise constituted by layered metal sheets, which have a preferred direction of magnetization. The preferred direction, by the appropriate tailoring of the spacers 9, extends parallel to the long cut edge of the spacers 9 or, in other words, in the longitudinal direction of the spacers 9. The orientation of the spacer 9 thus configured is established at an angle of between 70° and 110° in relation to the abutment joint 8.2. There is thus a respective difference between the preferred directions of magnetization of the spacers 9 and of the core metal sheets of between 25° and 65°. By this arrangement, effective magnetic bridging of the joints 8.2, and an advantageous magnetic flux distribution in the core region surrounding the cooling channel, are provided.

By the connection of the outer regions of the core and the limb by means of the spacers which are diagonally arranged in the abutment region, a proportion of the magnetic flux can employ a shortened magnetic path, thereby relieving the loading of the inner corner region of the abutment region between the core limb and the core yoke.

Figure 5:
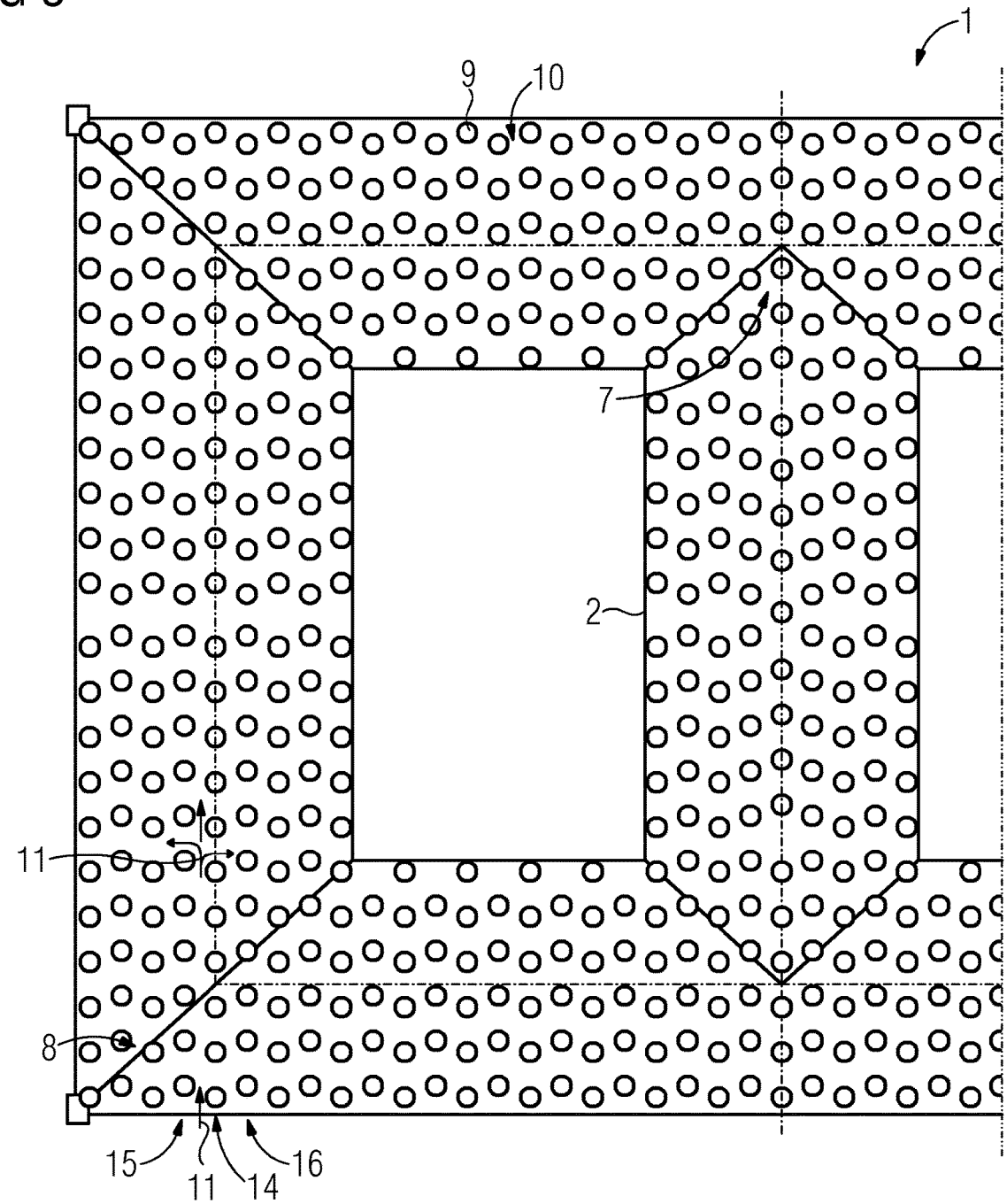
FIG. 5 shows a further exemplary embodiment of the core according to the invention.

FIG. 5 shows a further exemplary embodiment of the core 1 according to the invention, which differs from the exemplary embodiment represented in FIG. 1, in that the spacers 9, in the cross-sectional view represented, are configured in a circular rather than a rectangular design. The spacers 9 having a round or circular cross section provide the advantage that the dimensions thereof can be selected independently of the dimensioning of the core 1, thereby reducing production costs.

In the exemplary embodiment, the spacers are formed of aluminum disks.

Advantageously, the spacers 9 in one plane, for example the plane 14, are arranged with an offset in relation to the spacers 9 in the adjoining plane 15 or 16. Each spacer 9 in the plane 14 is therefore arranged opposite a gap between the spacer 9 in the plane 15 or 16. In this manner, the flux of the insulating fluid can be improved, as represented by the arrows 11.

Figure 6:
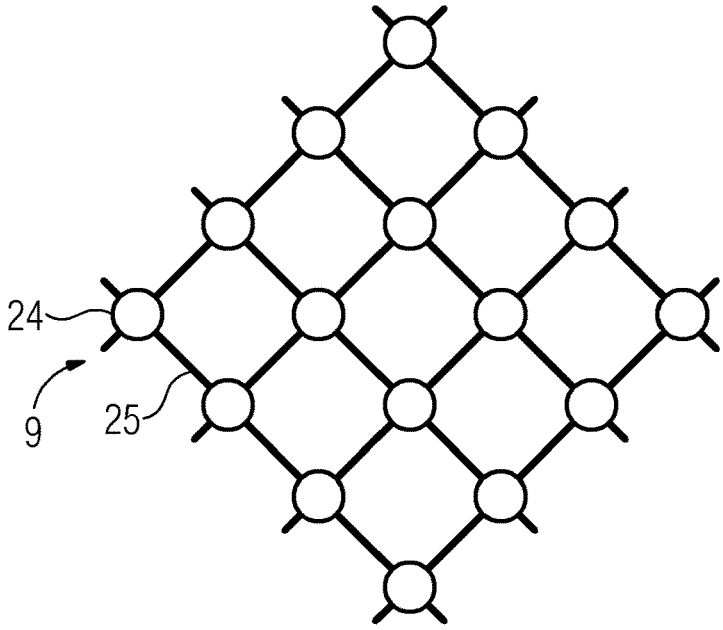
FIG. 6 illustrates a further exemplary embodiment of the core according to the invention.

FIG. 6 shows an exemplary embodiment, in which the spacers 9 are constituted in the form of circular metallic spacing segments 24. These spacing segments 24 are arranged in an offset manner on the surface of the metal sheets, in order to generate turbulence in the flux of the insulating fluid. The spacing segments 24 are interconnected by means of schematically represented reticulated connecting webs 25. These connecting webs 25 are configured with a smaller height than the spacing segments 24, in order to prevent any impairment of the flux of an insulating fluid. A spacing subassembly is produced accordingly, which permits simple installation.

Figure 7:
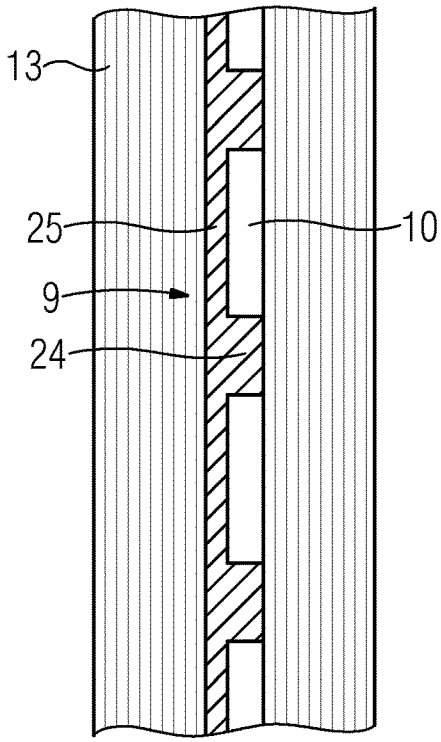
FIG. 7 illustrates finger-shaped spacers for the core according to the invention.

FIG. 7 shows the sectional representation of a spacer 9 according to FIG. 6. It can be seen that a cooling channel 10 is constituted between the metal sheets 13 by the spacing segments 9. The spacing segments 24 are interconnected by means of the connecting webs 25, wherein the height of the connecting webs 25 does not exceed 50% of the height of the spacing segments 9, in order to prevent any impairment of the flux of the insulating fluid in the cooling channel 10. The connecting webs 25 are configured here such that they contribute to the turbulence of the flux of the insulating fluid.

Figure 8:
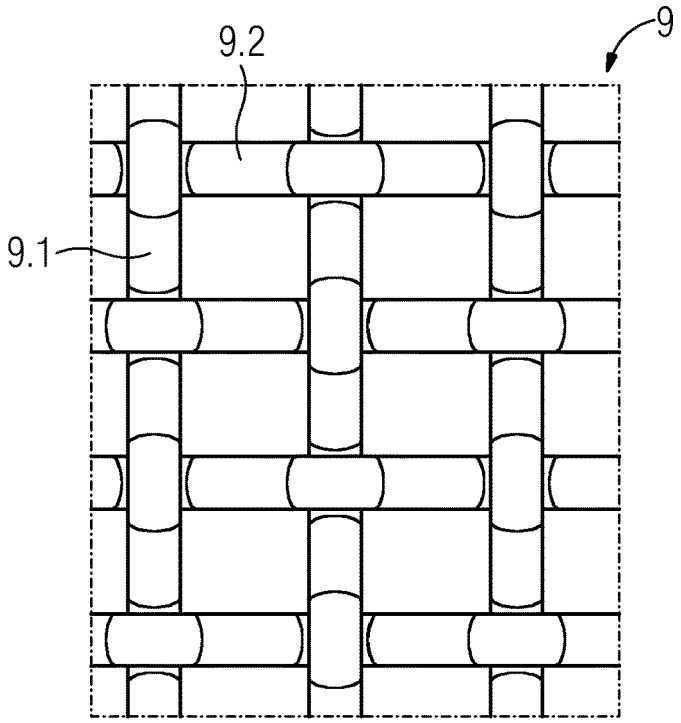
FIG. 8 shows a core with spacer, according to FIG. 7.
Figure 9:
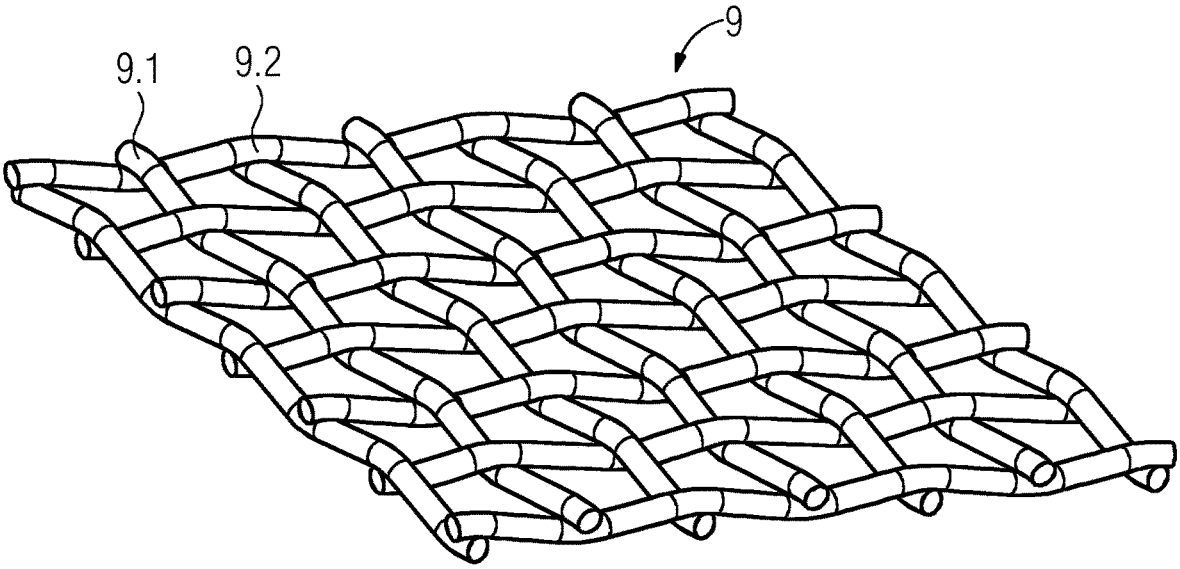
FIG. 9 shows a schematic illustration of an exemplary embodiment of a spacer 9.

FIGS. 8 and 9 show further examples of a spacer 9, which is configured here in the form of a wire mesh 9.1 and 9.2. The latter is available at a modest cost and, as a result of the round-section wire 9.1 or 9.2 employed, has no edges or sharp points which might damage the insulation of the core metal sheet 13. The execution of the spacer 9 in the form of a corrugated wire netting permits a wide variety of configurations, with extensive scope for adaptation to the geometrical characteristics of the cooling channels of the core.

Figure 10:
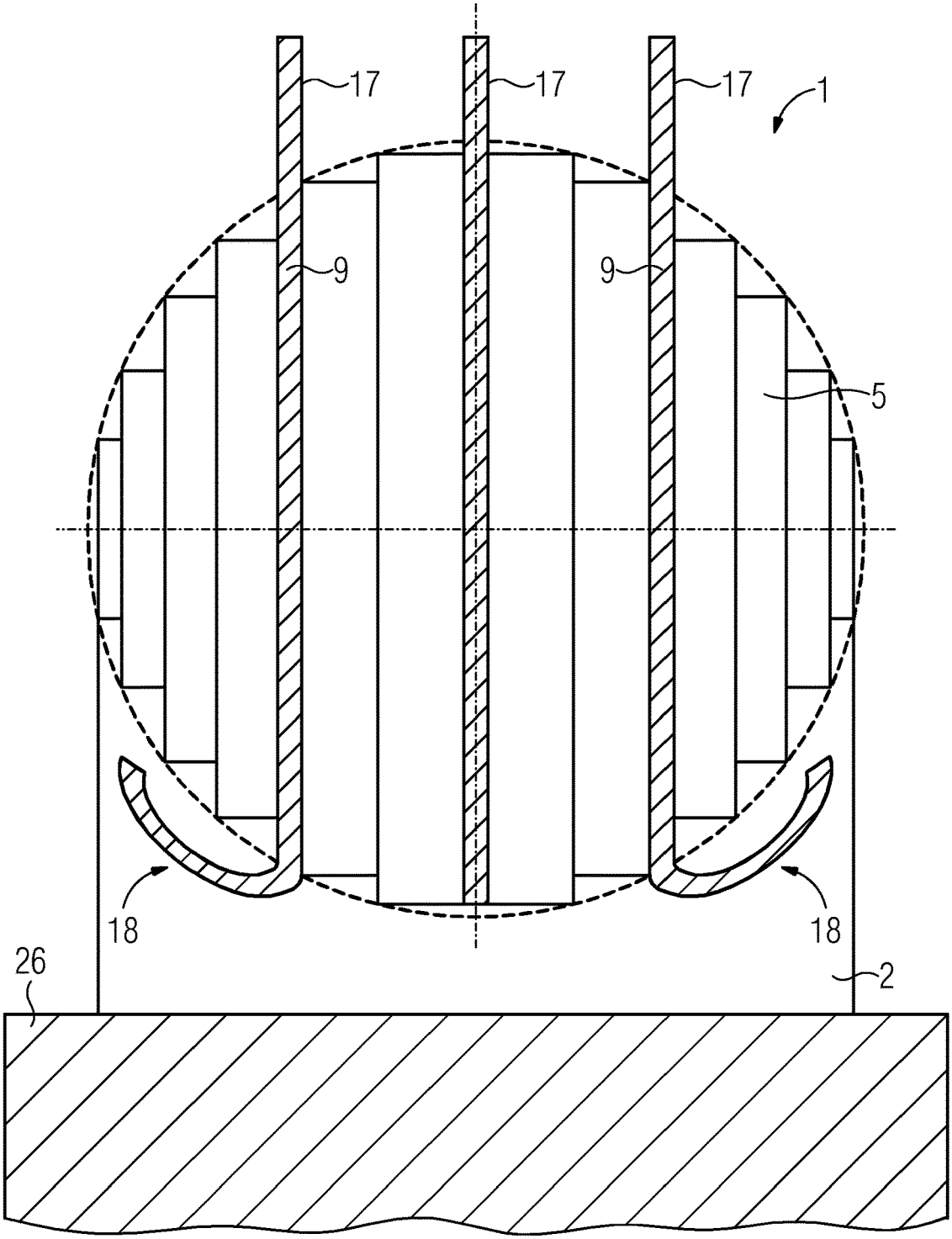
FIG. 10 shows an exemplary embodiment of the core 1 with a spacer according to FIG. 9, in a cross-sectional view.

FIG. 10 shows an exemplary embodiment of the core 1 according to the invention in a sectional side view. It can be seen that the metallic spacers 9 are configured as solid component 9, wherein a fixing section 17 thereof extends out of the core 1. In the exemplary embodiment, the spacers 9 and the fixing sections 17 are formed of steel. The fixing section 17 is equipped with elements for the fitting of lifting gear for the lifting and transport of the core. The compressed core 1 permits the effective transmission of the weight force of the core via the correspondingly configured spacers 9 and the fixing sections 17 integrated therein. The devices customary in the prior art for the attachment of lifting gear to the yoke clamping bars can be omitted.

The fixing sections 17 furthermore increase the surface area of the spacers 9, such that the evacuation of heat from the core 1 is improved even further.

Moreover, in the exemplary embodiment, the spacers 9 of the upper yoke 5, on the side thereof which, in the case of an application in a transformer, faces a winding 26 which carries a high voltage, are extended beyond the lower edge of the upper yoke 5 and, in the region of overlap with the winding 26, constitute an arch 18, which covers the adjacent outer core stage of the yoke 5. Accordingly, in the region of overlap of the high-voltage winding 26 by the upper yoke 5, critical corners of the core yoke are shielded with regard to the dielectric strength.

Figure 11:
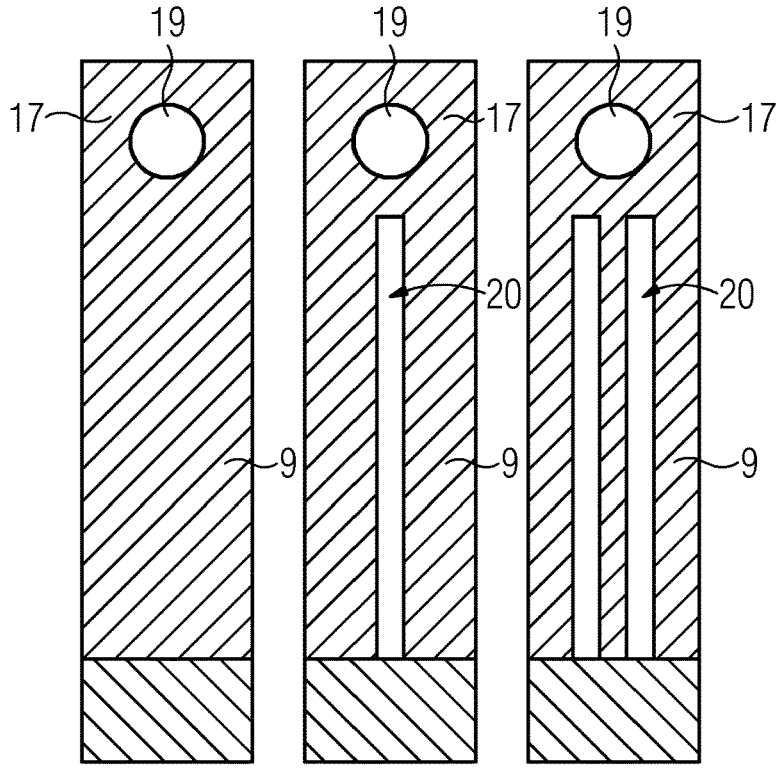
FIGS. 11 and 12 illustrate further exemplary embodiments of a spacer.

FIG. 11 represents exemplary embodiments of spacers 9, each of which is provided with a fixing section 17 for the lifting and transport of the core 1. In each fixing section 17, an eye 19 is provided for the attachment of lifting gear. In order to accommodate the weight of the core 1, the spacers 9 and the associated fixing sections 17 are of a correspondingly solid construction. The requisite width provided for this purpose results in a partial coverage of the surfaces of the core metal sheets adjoining the cooling channel. In order to prevent this, the relevant spacers in the exemplary embodiment are provided with finger-shaped webs, which seperate recesses 20.

The finger-shaped webs are mechanically designed to be able to accommodate the weight force of the core 1. They delimit recesses 20, which extend outwards in the form of ducts on both sides from the yoke metal sheets of the core 1, thereby permitting the admission and outlet of a cooling fluid.

Figure 12:
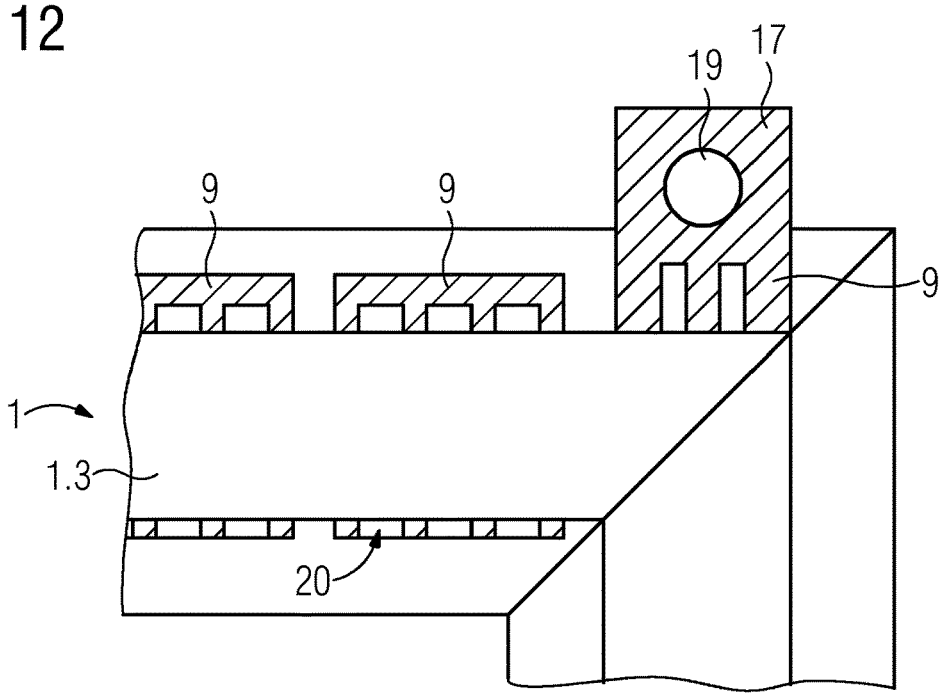

FIG. 12 illustrates the application of these finger-shaped spacing elements 9 in a core 1. The duct-shaped recesses 20 extend over the full height of the adjoining stage 1.3 of the core yoke, and constitute the cooling channels of the core 1. The spacing element 9 represented on the right-hand side of FIG. 12 is provided with a fixing section 17, which projects beyond the core 1. In the fixing section 17, an eye 19 for the fitting of lifting gear is configured, which permits the transport and lifting of the core 1.

Figure 13:
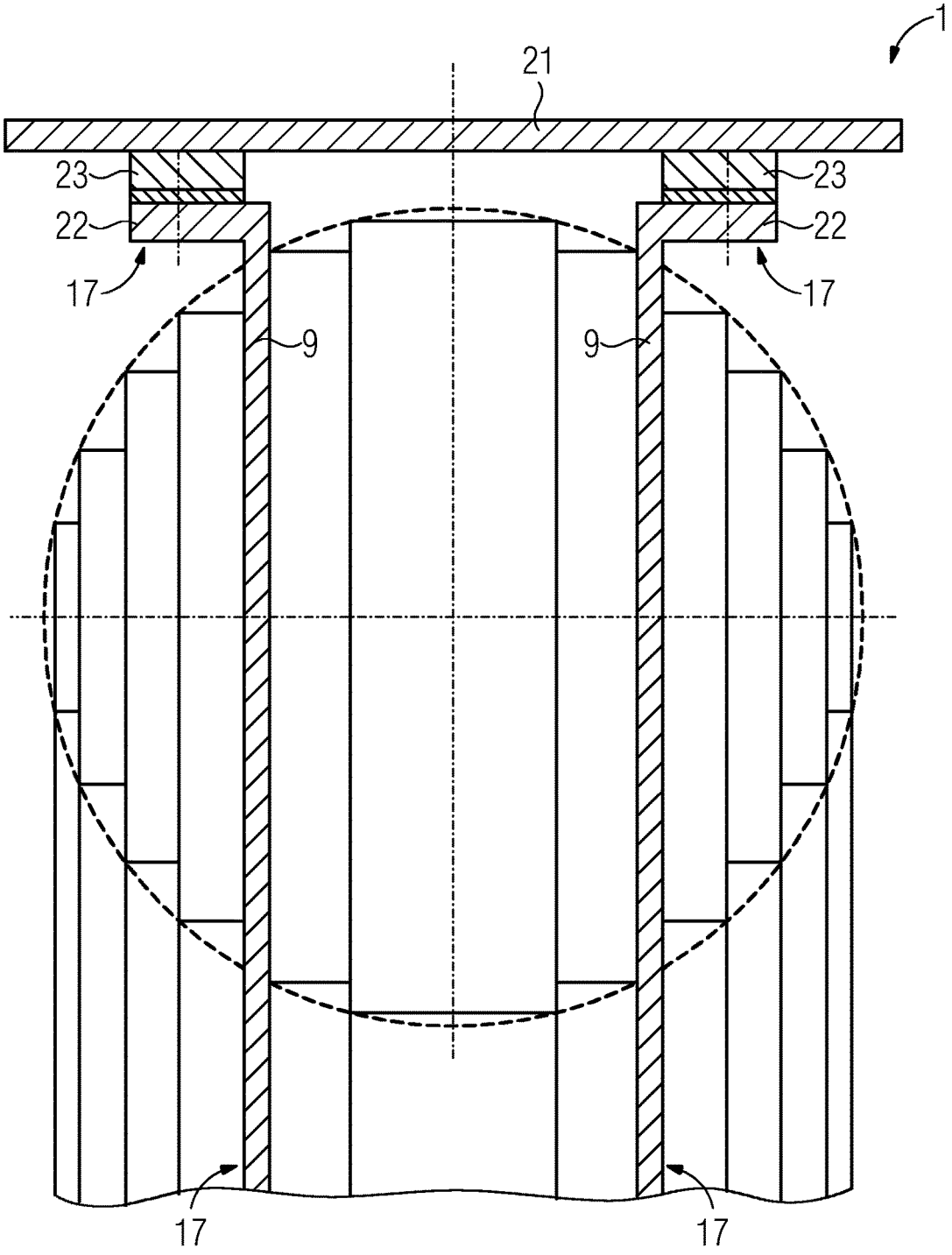
FIGS. 13 and 14 illustrate further exemplary embodiments of the core according to the invention.
Figure 14:
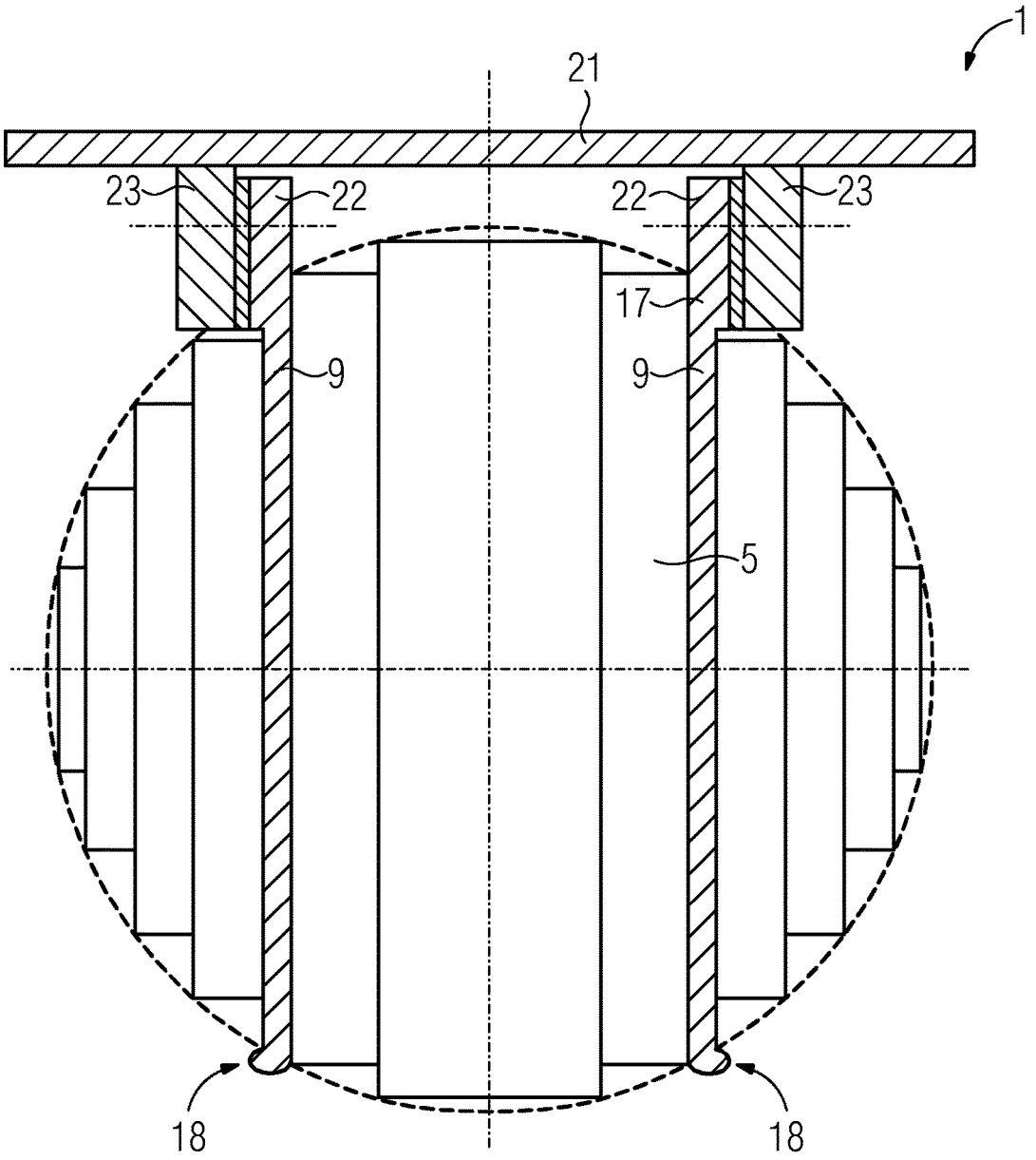

In FIGS. 13 and 14, exemplary embodiments of the core 1 according to the invention are represented, in which the metallic spacer 9, in the fixing section 17 thereof, constitutes a mounting bracket 22. In the view represented in FIG. 13, the mounting bracket 22 on two spacers 9 extends respectively in the horizontal direction. The function of the mounting bracket 22 illustrated is the attachment of a housing element, for example a top cover 21 of a transformer.

In FIG. 14, the mounting bracket extends respectively perpendicularly, wherein the top cover 21 constitutes fixing elements 23, by means of which it is attached to the mounting bracket 22. Moreover, in this case, the spacers of the upper yoke, in the region thereof which overlaps the transformer winding, are also extended 18 at their lower edge in relation to the adjoining core stage, and are rounded to a radius which is greater than the width of the cooling channel, in order to permit the electrical shielding, vis-à-vis the winding, of the core corners of the sheet metal stacks of the yoke having the greatest sheet metal width.

The invention claimed is:

1. A core for an electrical induction device, the core comprising:

a multiplicity of magnetizable metal sheets forming a stack of metal sheets resting on each other; and spacers being at least partially metallic and configured a flat bars, each of said spacers being disposed between two respective metal sheets, said spacers forming at least one cooling channel, and said spacers each having a side facing a respective metal sheet and an electrically insulating insulation layer disposed on said side.

2. The core according to claim 1, wherein said spacers are at least partially formed of a magnetizable material, and said magnetizable material is formed of layered magnetizable metal sheets.

3. The core according to claim 2, wherein said magnetizable material assumes a preferred direction of magnetization.

4. The core according to claim 3, which further comprises:

a limb and a yoke formed by said metal sheets;

a joint formed between said metal sheets of said limb and said yoke; and said preferred direction of magnetization and said joint forming an angle between 70 degrees and 110 degrees.

5. The core according to claim 1, wherein said spacers are fitted with at least one spring element.

6. The core according to claim 1, wherein said spacers are formed of an expanded metal mesh or a wire mesh.

7. The core according to claim 6, wherein said expanded metal mesh or wire mesh is secured in an elastically bent position in said stack of metal sheets.

8. The core according to claim 1, wherein said spacers have a fixing section projecting out of the core.

9. The core according to claim 8, wherein said fixing section forms a hook or an eye for attachment or lifting of the core.

10. The core according to claim 8, wherein said fixing section forms a mounting bracket for attachment to the electrical induction device.

11. The core according to claim 1, wherein said spacers are disposed in mutually parallel first and second planes as seen in a cross-sectional view, and said spacers in said first plane are configured in an offset configuration in relation to said spacers in said second plane.

12. The core according to claim 1, wherein said spacers are at least partially configured as hollow sections.

13. The core according to claim 1, wherein said spacers are formed of a multiplicity of mutually spaced-apart spacer segments being interconnected by connecting webs, said spacer segments have a height, and said connecting webs have a height corresponding to at most 50% of said height of said spacer segments.

14. The core according to claim 2, wherein said spacers include an inner region formed of a non-magnetic metallic material.

15. The core according to claim 3, wherein said spacers include an inner region formed of a non-magnetic metallic material.

16. The core according to claim 4, wherein said spacers include an inner region formed of a non-magnetic metallic material.

17. The core according to claim 8, which further comprises:

an upper yoke having a lower edge and a side facing a high voltage winding when installed in a transformer;

said upper yoke having spacers on said side being extended beyond said lower edge and having a region of overlap with said yoke forming an arch over said winding partially covering said yoke.

18. The core according to claim 9, which further comprises:

an upper yoke having a lower edge and a side facing a high voltage winding when installed in a transformer;

said upper yoke having spacers on said side being extended beyond said lower edge and having a region of overlap with said yoke forming an arch over said winding partially covering said yoke.

19. The core according to claim 10, which further comprises:

an upper yoke having a lower edge and a side facing a high voltage winding when installed in a transformer;

said upper yoke having spacers on said side being extended beyond said lower edge and having a region of overlap with said yoke forming an arch over said winding partially covering said yoke.

* * * * *